US005881948A

United States Patent [19]

Correll

[11] Patent Number: 5,881,948

[45] Date of Patent: Mar. 16, 1999

[54] EXPANDABLE PIZZA BOX AND METHOD OF USE

[76] Inventor: John D. Correll, 8459 Holly Dr., Canton, Mich. 48187

[21] Appl. No.: 2,153

[22] Filed: Dec. 31, 1997

Related U.S. Application Data

[63] Continuation-in-part of Ser. No. 731,586, Oct. 16, 1996, Pat. No. 5,833,130.

[51] Int. Cl.[6] ..... B65D 5/22

[52] U.S. Cl. ..... 229/123; 229/101; 229/177; 229/178; 229/906

[58] Field of Search ..... 229/101, 123, 229/149, 152, 153, 154, 177, 178, 902, 906; 206/515, 518

[56] References Cited

U.S. PATENT DOCUMENTS

| | | | |
|---|---|---|---|
| 2,105,953 | 1/1938 | Ouellette | 229/123 |
| 2,608,340 | 8/1952 | Donnell . | |
| 2,663,487 | 12/1953 | Paige . | |
| 2,793,802 | 5/1957 | Scaturro | 229/123 |
| 3,373,923 | 3/1968 | Martelli | 229/123 |
| 3,520,409 | 7/1970 | Gibbs, Sr. | 229/123 |
| 3,669,341 | 6/1972 | Hughes | 229/123 |
| 3,834,526 | 9/1974 | Zine, Jr. | 229/178 |
| 3,900,157 | 8/1975 | Roth | 229/123 |
| 4,111,306 | 9/1978 | Roccaforte . | |
| 4,295,599 | 10/1981 | Locatelli et al. . | |
| 4,979,667 | 12/1990 | Seaman | 229/114 |
| 5,060,851 | 10/1991 | Lorenz | 229/125.29 |
| 5,402,930 | 4/1995 | Storms et al. | 229/125.28 |

*Primary Examiner*—Gary E. Elkins

[57] ABSTRACT

A one-piece expandable pizza box having a bottom panel, a fully-reclinable rear wall, a cover attached to the rear wall, at least one fall-back side wall structure with a side wall that can assume both a vertical position and a fall-back position, and a double-panel wall adjacent the side wall; plus an associated method of use involving placing a pizza into the partially-erected expandable pizza box and causing the side wall to move from the fall-back position to the vertical position.

22 Claims, 4 Drawing Sheets

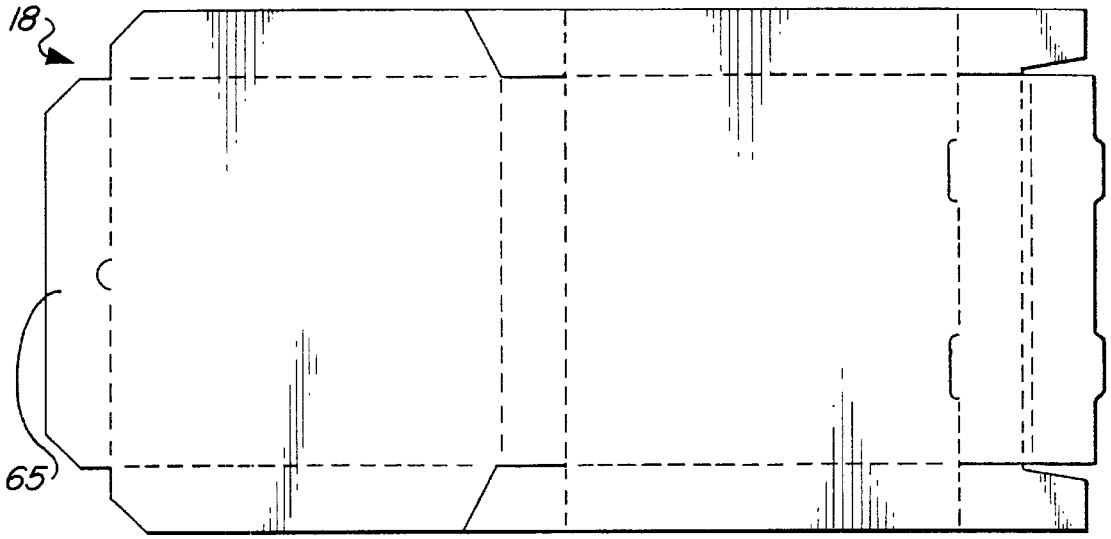
FIG-5
PRIOR ART
FIG-6
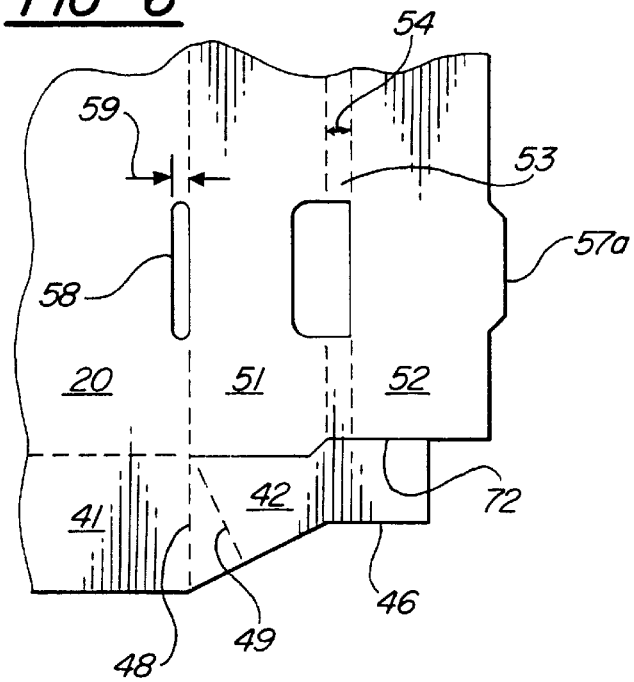
FIG-7
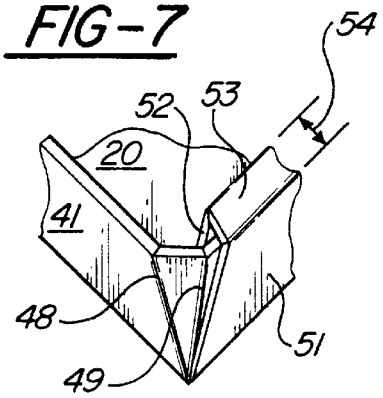
FIG-8
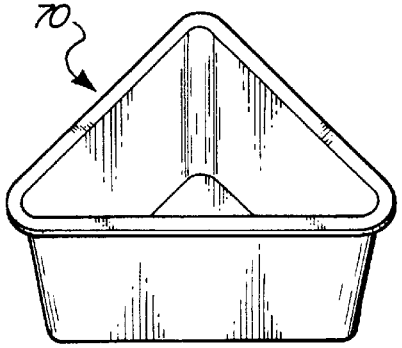

EXPANDABLE PIZZA BOX AND METHOD OF USE

CROSS-REFERENCES TO RELATED APPLICATIONS

This is a continuation-in-part of application Ser. No. 08/731,586, entitled "Multi-function Pizza Carton," filed on Oct. 16, 1996, U.S. Pat. No. 5,833,130.

FIELD OF THE INVENTION

This invention relates to foldable boxes, in general, and to expandable pizza boxes, in particular.

DESCRIPTION OF THE PRIOR ART

Currently in the pizza industry, the standard carton is a one-piece corrugated box with stationary front and side walls disposed perpendicular to a bottom panel. These walls remain in vertical position when the box is both open and closed. Thousands of pizza companies use this box, including Pizza Hut, Little Caesars, and Papa John's.

The basic structure of this standard box comprises a bottom panel, a fully-reclinable rear wall with a cover hingedly attached, a pair of opposing side walls, and a double-panel front wall that encloses front corner flaps which are attached to the side walls, thereby creating connected corners at the front of the box. A typical blank 18 used for making this box is shown in FIG. 5.

Used with the standard box are two basic pizza-cutting techniques: in-box cutting and out-of-box cutting. With in-box cutting, the product is placed inside the box and then cut with a pizza wheel, which is a circular blade attached to a handle. The pizza wheel slices the product by rolling across it. In out-of-box cutting, the product is placed on a board or pad and then cut either with the pizza wheel or with a rocker knife; after which the sliced pizza is slid from the board into the box.

With the standard box, there are problems with both cutting techniques. With in-box cutting, in order to slice the pizza all the way to the edge, it's necessary to "run over" the stationary vertically-disposed side walls with the pizza wheel, thereby creasing the walls and bending them permanently outward, which makes for a sloppy-looking box.

With out-of-box cutting, when the product is slid from the board into the box, slices of pizza often get caught on the top edge of the side walls, causing disruption of the product. To overcome this problem, some pizza companies have resorted to an oversized box that is one-half to three-fourths inch wider than the pizza's diameter. However, this results in higher packaging cost and the extra space also fosters slice separation during delivery.

In an attempt to overcome the above problems, a few pizza companies have resorted to a folder style, or disconnected-corner, carton. With this, there are no connected corners to the box so that the side walls fall outward and lay flat when the cover is open. This enables pizza-cutting on the open box without having vertical walls interfering with the pizza wheel. However, this approach brings the following new problems: (a) the carton can lack stacking strength compared to the standard box, (b) it can form a sloppy-looking shape once the cover is opened, and (c) it often requires new, and sometimes difficult, folding and handling techniques compared to the standard box. As a result, this style of carton is unworkable and unacceptable for many pizza companies.

To solve the problems associated with both in-box and out-of-box pizza cutting, without incurring the drawbacks of a folder style or disconnected-corner carton, a connected-corner pizza box needs to have side walls that angle or slope outwards. Recently, several variations of sloping-wall pizza boxes have appeared in the prior art. They are: Seaman U.S. Pat. No. 4,979,667 granted Dec. 25, 1990; Lorenz U.S. Pat. No. 5,060,851 granted Oct. 29, 1991; and Storms et al. U.S. Pat. No. 5,402,930 granted Apr. 4, 1995.

However, even though these boxes have sloping walls, all three have drawbacks. First, the sloping walls are stationary, meaning that they are in sloped disposition even when the cover is open. The problem with this is: Sloping walls tend to result in reduced stacking strength or crush resistance, which can be a serious problem for a delivery pizza operation, especially one that stacks multiple loaded boxes for large orders.

Further, all of the inventions are two-piece cartons, or cartons consisting of separate tray and cover components. Compared to a standard one-piece box having a cover hingedly attached to a rear wall, a two-piece carton raises packaging cost because it either (a) requires more material than a one-piece box or (b) has glued corners, which necessitates a more costly production process.

Further, these boxes require substantially different folding and handling procedures than the standard box. The problem with that is: A box that requires a radical change of procedures confuses employees and, thereby, increases the complexity of a pizzeria operation—a situation that many pizzeria owners and managers deplore. Therefore, it's a benefit when a new box has similar folding and handling procedures to that of the standard pizza box.

So there has developed a need for a type of one-piece non-glued corrugated pizza box with connected corners that (a) has side walls that slope outward when the box is open but which are vertically-disposed when the box is closed and (b) is capable of being erected from a blank into a box using a similar procedure to that employed with the standard box.

In the prior art there are non-pizza boxes that have walls that slope outward when the box is open and that move to a vertical position when the box is closed. The most pertinent examples are: Donnell U.S. Pat. No. 2,608,340 granted on Aug. 26, 1952; Paige U.S. Pat. No. 2,663,487 granted on Dec. 22, 1953; Roccaforte U.S. Pat. No. 4,111,306 granted on Sep. 5, 1978; and Locatelli et al. U.S. Pat. No. 4,295,599 granted on Oct. 20, 1981.

However, even if these non-pizza boxes were constructed with dimensions to accommodate a pizza, they would still pose many problems and, therefore, be unacceptable. For example, Donnell would require substantially more material than a standard pizza box and, therefore, would be much more costly. Also, the two-piece (split) cover of Donnell would separate and sag in the center when the box is loaded with hot pizza.

Paige, which is a two-piece box, would require substantially more material than a standard box. It also would require substantially more time to erect due to the need to physically attach the cover.

Roccaforte, which has a glued cover with a tear strip, would require set-up or folding procedures that are unworkable for a pizzeria. Plus, the box would likely not even work when made of corrugated paperboard, which is what most pizza companies require for their pizza carton.

Locatelli et al. would require substantially more material than a standard box.

Finally, all of the boxes would require an erecting procedure that is fundamentally different from that which is currently used in most pizzerias. This would cause confusion and difficulties for pizzeria personnel.

So, there has remained a problem of how to solve the pizza-cutting needs of pizzerias with an expandable connected-corner box without incurring attendant drawbacks of increased packaging cost, reduction in stacking strength, and confusion and increased training time over different box-folding and handling methods.

This problem has not been solved by the prior art but is solved by my invention. By solving this problem, a pizza company can eliminate the packaging problems pertaining to in-box and out-of-box pizza-cutting without incurring higher cost, reduced performance, or increased training burden created by adopting a new box.

In conclusion, it would be highly desirable to provide a one-piece expandable pizza box that overcomes the above-described problems and disadvantages.

OBJECT AND ADVANTAGES

Accordingly, the object of my invention is a one-piece expandable pizza box which utilizes folding and handling procedures similar to those of the standard pizza box, and which can be formed into:

a) A partially-erected box with sloping side walls to facilitate convenient pizza-cutting and box-loading and, also, to allow easy nesting together of multiple partially-erected boxes to conserve space; and b) A fully-erected box with vertical side walls and corner flaps to facilitate maximum stacking strength.

A further object of my invention is a method of using the above box and its blank for optimum pizza-cutting and handling results.

The advantages of my invention are:

1) Easy, unobstructed loading of a pizza into the box;

2) Easier cutting of a pizza inside the box;

3) More complete cutting of the pizza in the box and/or a better-looking box due to no bent side walls from the cutting;

4) Easy nesting together of partially-erected boxes for space-savings, especially boxes made of B-flute corrugated board;

5) No added training time and employee confusion resulting from radically different box-folding and handling procedures;

6) No additional packaging cost due to increased material or gluing process required to make the box.

Further objects and advantages of the invention will become apparent from consideration of the following detailed description, related drawings, and appended claims.

SUMMARY OF THE INVENTION

My invention is a one-piece expandable pizza box that uses folding and handling procedures similar to those of the standard pizza box and which has an associated method of use for packaging pizza. The box comprises a bottom panel, a fully-reclinable rear wall, a cover attached to the rear wall, at least one fall-back side wall structure with a side wall that can assume both a vertical position and a fall-back position, and a double-panel wall adjacent the side wall and which encloses a fall-back corner flap attached to an end of the side wall.

The method of use involves placing a pizza into a partially-erected expandable pizza box and causing the side wall to move from the fall-back position to the vertical position. Other steps can be added to the method to adapt it to the needs of a particular pizzeria.

As used herein, the term "expandable pizza box" is defined as a box specially configured to hold pizza and which has side walls that can move from a vertical position to a fall-back position when the box is open. A complete understanding of the invention can be obtained from the detailed description that follows.

BRIEF DESCRIPTION OF THE DRAWINGS

FIG. 5 is a plan view of a blank of the standard pizza box.

FIG. 6 is a plan view of an alternate configuration of the fall-back corner flap for the preferred embodiment.

FIG. 7 is a perspective view of the corner formed from the alternate configuration of fall-back corner flap.

FIG. 8 is a perspective view of a three-sided sauce cup.

LIST OF REFERENCE NUMERALS

Figure 1:
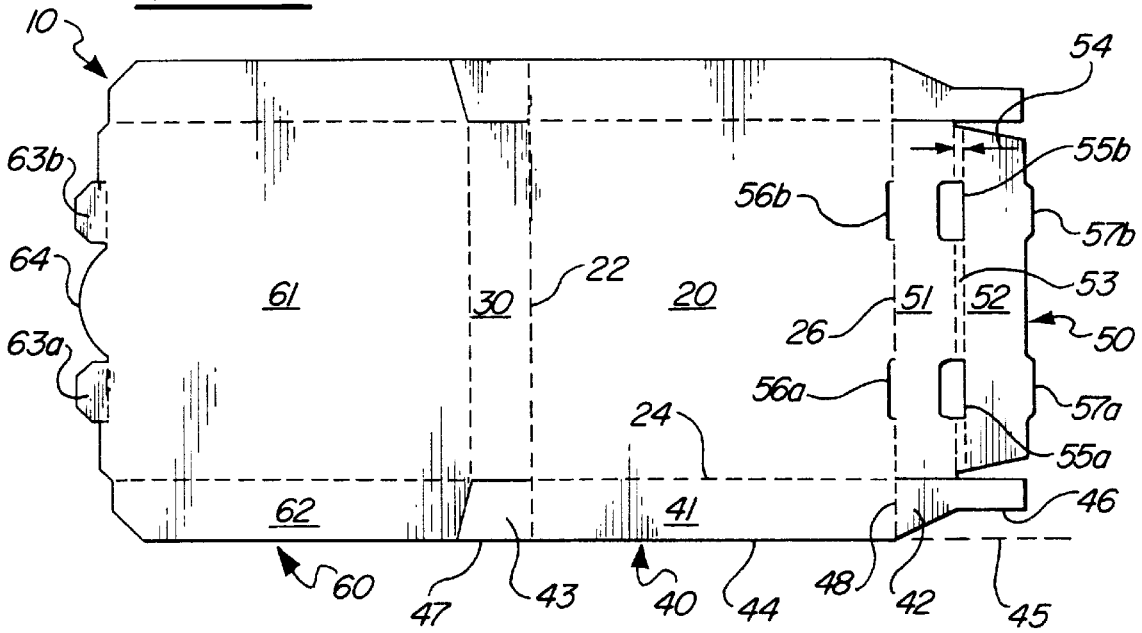
FIG. 1 is a plan view of the blank of the preferred embodiment.

Between drawings, like reference numerals designate corresponding parts.

| | |
|---|---|
| 10 | blank of preferred embodiment |
| 12 | fully-erected box |
| 14 | partially-erected box |
| 16 | stack of partially-erected boxes |
| 18 | blank of typical standard box |
| 20 | bottom panel |
| 22 | rear edge |
| 24 | side edge |
| 26 | front edge |
| 30 | rear wall |
| 40 | fall-back side wall structure |
| 41 | side wall |
| 42 | fall-back corner flap |
| 43 | verticalizing flap |
| 44 | top edge |
| 45 | imaginary line of projection |
| 46 | top edge |
| 47 | top edge |
| 48 | fold line |
| 49 | diagonal fold line |
| 50 | double-panel wall structure |
| 51 | outer panel |
| 52 | inner panel |
| 53 | top-edge fold line structure |
| 54 | predetermined distance |
| 55a | first cover interlock means |
| 55b | second cover interlock means |
| 56a | first slot-forming tab |
| 56b | second slot-forming tab |
| 57a | first interlock portion |
| 57b | second interlock portion |
| 58 | interlock slot |
| 59 | predetermined distance |
| 60 | cover |
| 61 | cover panel |
| 62 | cover side flap |
| 63a | first interlock flap |
| 63b | second interlock flap |
| 64 | front edge projection tab |
| 65 | single front flap |
| 70 | sauce cup |
| 72 | tab |

DESCRIPTION OF THE PREFERRED EMBODIMENT

Referring now to the drawings, there is illustrated a preferred embodiment of the invention in the format of a one-piece corrugated paperboard blank and also in the formats of partially-erected and fully-erected boxes created from the blank. It is noted that the invention is bilaterally symmetrical. Therefore, for simplicity of description, only the components on one side of the invention are indicated by numerals in the drawings and are referenced in the ensuing discussion. It is to be understood that the description inferentially applies to the corresponding components on the other side, even though they may not be mentioned.

All referenced components are labeled in FIG. 1; selected components are labeled in other Figures.

Structure of the Invention

Figure 2:
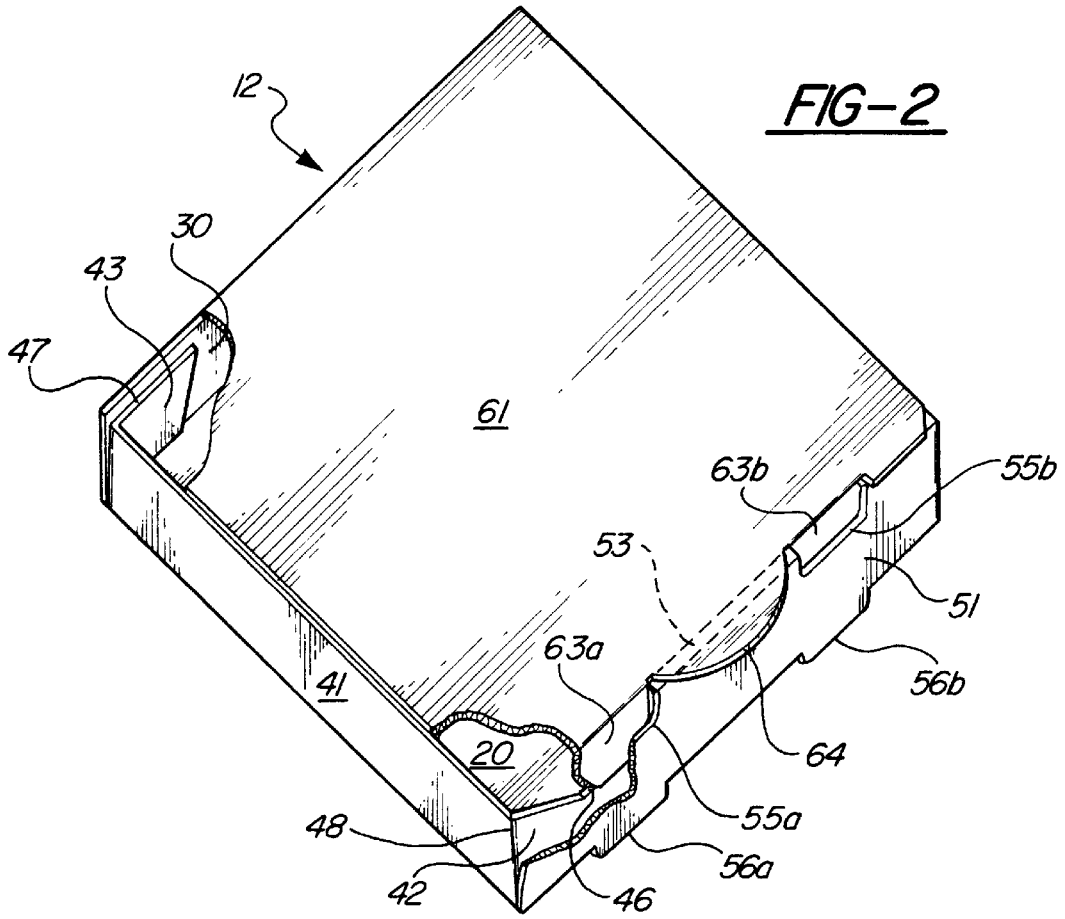
FIG. 2 is a perspective view of a fully-erected box formed from the blank.
Figure 3:
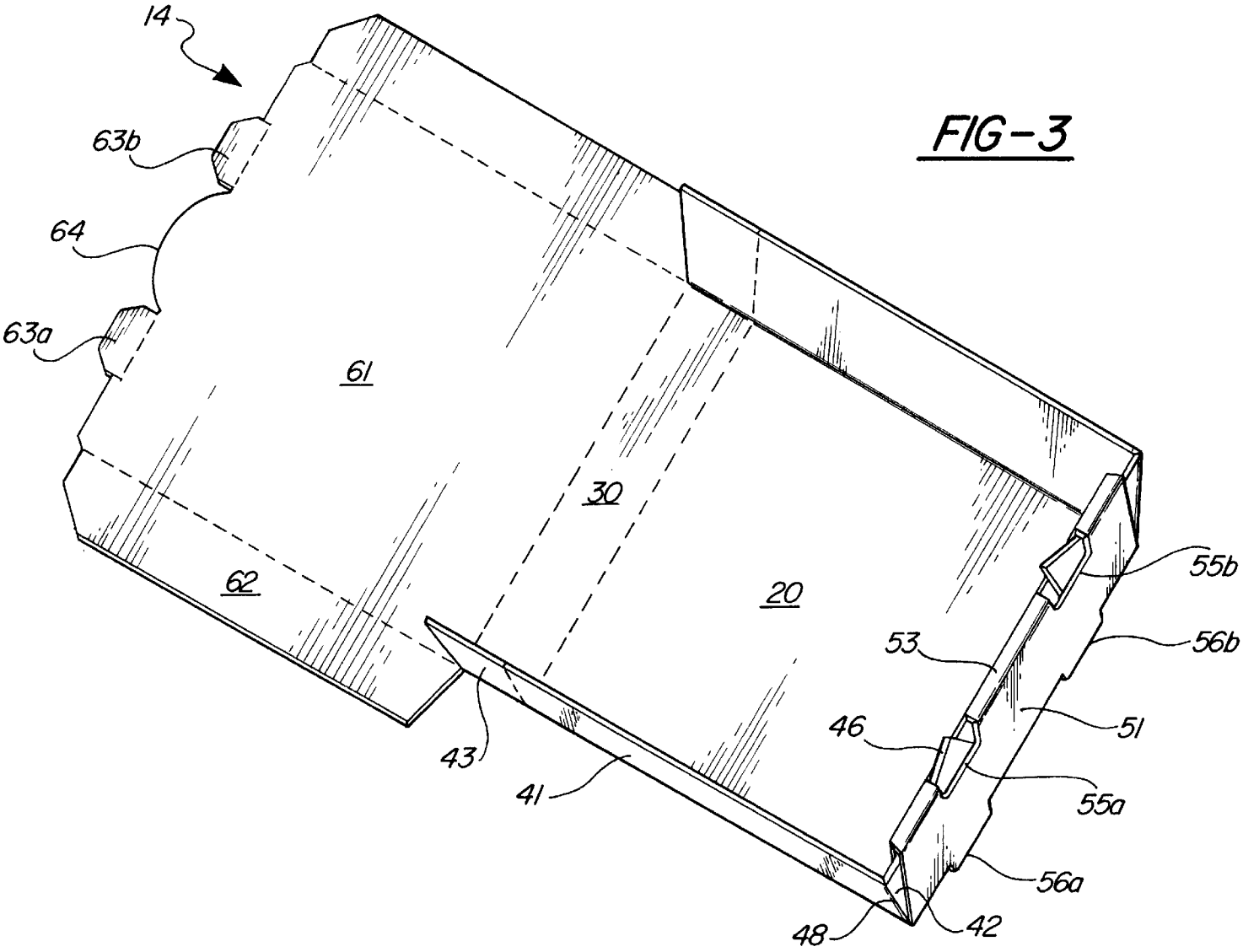
FIG. 3 is a perspective view of a partially-erected box formed from the blank.

Referring now to blank 10, fully-erected box 12, and partially-erected box 14 shown in FIGS. 1, 2, and 3, respectively, there is a bottom panel 20 which has a rear edge 22, a side edge 24 perpendicular to the rear edge, and a front edge 26.

A rear wall 30 is hingedly attached to edge 22. The wall is "fully-reclinable," meaning that when the box cover is opened and layed back, the rear wall can recline from a vertical to a horizontal position.

A fall-back side wall structure 40 comprises a side wall 41 hingedly attached to edge 24, a fall-back corner flap 42 hingedly attached to a front end of wall 41 at fold line 48 and a free-swinging verticalizing flap 43 hingedly attached to a rear end of wall 41. As shown in FIG. 1, side wall 41 has a top edge 44 and an imaginary line of projection 45 that extends from top edge 44. Flap 42 has a top edge 46 which, it should be noted, lies substantially below line of projection 45. And flap 43 has a top edge 47.

As used herein, the term "fall-back corner flap" is defined as a flap attached to an end of a side wall and which is of a shape that, when disposed between the panels of an adjacent double-panel wall, can move from a downward position to an upward position and vice versa; and, thereby, can correspondingly allow the side wall to move from a vertical position to a fall-back position and vice versa.

The term "verticalizing flap" is defined as a flap attached to an end of a non-stationary or movable side wall and which acts to keep the wall from moving from a vertical position to a fall-back position when the cover is closed on the box.

A double-panel wall structure 50 comprises an outer panel 51 attached to edge 26 and an inner panel 52 attached to a top edge of panel 51 by a top-edge fold line structure 53. It's possible for fold line structure 53 to consist of a single fold line. However, as shown in FIGS. 1 and 6, in the preferred embodiment fold line structure 53 comprises two parallel, or nearly parallel, fold lines spaced apart by a predetermined distance 54 and having a narrow strip of material between the fold lines.

First and second cover interlock means 55*a* and 55*b*, respectively, are disposed in wall structure 50. In the preferred embodiment, these means constitute large slot-like openings disposed in panel 51 and fold line structure 53. However, it's possible for these interlock means to assume other configurations and dispositions in wall structure 50.

Further, outer panel 51 has first and second slot-forming tabs 56*a* and 56*b* projecting from a bottom edge of the panel. Inner panel 52 has first and second interlock portions 57*a* and 57*b* projecting from a bottom edge. When the blank is folded into a box, tabs 56*a* and 56*b* result in openings, or interlock slots, in the bottom of the box which receive interlock portions 57*a* and 57*b*, thereby holding inner panel 52 in a parallel, or nearly parallel, disposition to outer panel 51.

In boxes 12 and 14 shown in FIGS. 2 and 3, fall-back corner flap 42 is disposed between panels 51 and 52 and, therein, undergoes a degree of frictional resistance resulting from contact with the panels. Depending on the length of predetermined distance 54, the degree of frictional resistance on flap 42 can be made high or low. By using a wider distance 54, the resistance can be decreased; by using a narrower distance 54, the resistance can be increased. Generally speaking, to create a moderate amount of resistance, distance 54 should be less than three times the thickness of the corrugated board of which the box is made. To create virtually no resistance, distance 54 should be greater than three times, and perhaps as much as four times, the thickness of the corrugated board. It is noted that in the preferred embodiment, distance 54 can be made to assume any of those lengths.

In the fully-erected box 12, top edge 46 lies substantially below fold line structure 53. This gap enables fall-back flap 42 to assume either a downward position, which is shown in box 12, or an upward position, which is shown in partially-erected box 14. When flap 42 is in the downward position side wall 41 is in a vertical position. When the flap is in the upward position, the side wall is in a fall-back or outward-angling position, shown in box 14.

As used herein, the term "vertical position" is defined as a position wherein the side wall is substantially perpendicular to bottom panel 20, although not necessarily exactly perpendicular. The term "fall-back position" is defined as a position wherein the side wall is disposed at an angle in relation to panel 20 that is substantially greater than the angle of the vertical position. Accordingly, in the fall-back position the side wall is disposed at an oblique angle to panel 20.

Fall-back flap 42 can assume configurations other than that shown in the preferred embodiment. One such configuration is illustrated by FIG. 6, which shows a corner section of a blank, and in FIG. 7, which shows a corner section of a partially-erected box formed from the blank. Within this flap configuration, there is a diagonal fold line 49. The fold line is positioned so that, in the box format, it corresponds with the end edge of panel 52 when side wall 41 is in fall-back position. In a partially-erected box, flap 42 will bend along fold line 49 during pizza cutting and, thereby, enable wall structure 50 to slope outwards, as illustrated in FIG. 7. The drawback of this arrangement is that, once the flap is bent along fold line 49, it doesn't easily slide from the upward position to the downward position due to added frictional resistance with panels 51 and 52. This can necessitate added time in closing up the box.

An alternate form of interlock slot, indicated as slot 58, is shown in FIG. 6. Instead of being formed by a slot-forming tab (56*a*/*b*), this opening results from a knock-out in the blank.

In the box form of the preferred embodiment, there are first and second interlock slots, even though only one is shown in FIG. 6. In boxes 12 and 14 the slots are hidden from view by wall panel 51.

Each of the interlock slots has a front-to-back width equivalent to a predetermined distance 59, as shown in FIG. 6. Depending on the length of distance 59, the degree of frictional resistance on flap 42 can be made high or low. By using a wider distance 59, the resistance can be decreased; by using a narrower distance 59, the resistance can be increased. Generally speaking, to create a moderate-to-high amount of resistance, distance 59 should be less than three times the thickness of the corrugated board of which the box is made. To create virtually no resistance, distance 59 should be equal to or greater than three times the thickness of the corrugated board. It is noted that in the preferred embodiment, distance 59 can be made to assume any of those lengths.

In summary, there are two ways to adjust the degree of frictional resistance on corner flap 42. One way is by adjusting the length of distance 54 and the other way is by adjusting the length of distance 59.

The alternate configuration of flap 42 (shown in FIG. 6) also has a tab 72 that projects downward from the bottom edge of the flap. In a fully-erected box, when flap 42 is in the downward position, tab 72 projects through slot 58. When distance 59 is less than three times the thickness of the corrugated board of which the box is made, the projecting of tab 72 through slot 58 creates a degree of frictional resistance. The benefit of this arrangement is that it tends to hold flap 42 in the downward position and, thereby, hold side wall 41 in the vertical position. The drawback is that flap 42 will not automatically assume the fall-back position when the box is opened up and, therefore, must be manually pushed to that position.

A cover 60 is hingedly attached to a top edge of rear wall 30 at a fold line. The cover comprises a cover panel 61, a cover side flap 62 attached to a side edge of panel 61, and first and second interlock flaps 63*a* and 63*b*, respectively, attached to a front edge of panel 61. A front edge projection tab 64 is located between flaps 63*a* and 63*b*. In the fully-erected box, this projection tab extends forward beyond wall structure 50 and, thereby, provides an "easy-grab tab" that can be used for easily extracting a box from the bottom of a stack and for easily opening the cover of the box. In the preferred embodiment, this projection is at least 30 millimeters wide and, at its furthest point, extends beyond wall panel 51 by more than six millimeters. These dimensions would be considered the minimum dimensions for creating a workable easy-grab tab. Larger dimensions would provide for easier grasping and, therefore, be preferred.

In the fully-erected box, cover side flap 62 is disposed on the interior side of side wall 41 and flaps 63*a* and 63*b* can be inserted into cover interlock means 55*a* and 55*b*, thereby locking cover 60 into closed position. Another reason for interlocking the cover with the front wall structure on an expandable pizza box is that it adds important rigidity to the carton. Without an interlock between the cover and front wall structure, there's a tendency for the cover side flap to push the side wall outward when a loaded box is grasped at a rear corner with one hand. However, even with just one cover interlock flap engaged with the double-panel front wall, this problem is prevented.

It is noted that tabs 56*a* and 56*b* of outer panel 51 are positioned directly below cover interlock means 55*a* and 55*b*, respectively. Thereby, when one fully-erected box is stacked directly on top of another, tabs 56*a* and 56*b* of the upper box extend downward in front of cover flaps 63*a* and 63*b* of the lower box and, so, do not rest on cover panel 61. This enables multiple units of box 12 to be stacked is level, or without resulting in a backward-leaning stack.

An alternate configuration for cover 60 can be employed by substituting a single, full-width front flap of the type used in the standard pizza box in place of flaps 63*a* and 63*b*. This flap is shown as flap 65 in blank 18, FIG. 5. If this substitution were made to the preferred embodiment, interlock means 55*a* and 55*b* could be omitted from wall structure 50. In the fully-erected box, flap 65 would be positioned interior to structure 50 and, thereby, would not be engaged or interlocked with the structure. A drawback of this arrangement is that it can result in accidental cover opening, as can happen with a standard box. Its benefit is that the box closes up exactly the same way as the standard box, a feature that could be preferred by some pizzeria operators.

Within the context of this invention, a fold line can be created by a number of means such as, for example, by a crease or score in the board, by a series of aligned spaced short slits in the board, and by a combination of aligned spaced short and long slits. In conclusion, as referred to herein, a fold line is any line between two points on the blank or box along which the board is intended to be folded when the blank is being erected into a box. The type of fold lines shown in the drawings are presently preferred but it will be appreciated that other methods known to those skilled in the art may be used.

Method of Use

As previously noted, the invention has been designed to have a folding and handling methodology that is similar to that of the standard pizza box, thereby providing a familiar feel and requiring little or no employee training time. In addition, to gain maximum benefit from the box, a unique pizza packaging method can be employed.

To erect the blank into a box, the following procedure is used. It is noted that this is the same procedure that's used for erecting the standard pizza box. First, simultaneously erect both side wall structures 40 by folding flap 42 to upright position and then folding side wall 41 inward or to upright position. Second, erect double-panel wall structure 50 by folding panel 51 to upright position and then folding panel 52 downward until interlock portions 57*a* and 57*b* engage with the interlock slots in the bottom of the box. You now have a partially-erected box, which is box 14 in FIG. 3. With this box, flaps 42 are enclosed between the inner and outer panels, rear wall 30 and cover 60 are disposed coplanar to bottom panel 20, and side walls 41 are in fall-back position.

At this point, there are three ways the partially-erected box can be used, called options one, two, and three.

Option one involves the following steps. First, a pizza is placed into the partially-erected box. Second, side walls 41 are caused to move from the fall-back position to a vertical position. This can be accomplished by folding verticalizing flaps 43 inward and then pushing side walls 41 to vertical position. Finally, the partially-erected box is formed into a fully-erected box. This can be accomplished by pulling cover 60 upright, folding cover flaps 62 inward, and pulling the cover downward onto the box. As this is done, cover panel 61 contacts top edge 47 of verticalizing flap 43, thereby holding side wall 41 in the vertical position. To lock the cover in place, fold interlock flaps 63*a* and 63*b* downward and tuck them into interlock means 55*a* and 55*b*.

It is noted that, as shown with flap 63*a* in FIG. 2, interlock flaps 63*a* and 63*b* and corner flaps 42 are of such length and shape that, after the interlock flaps are engaged in interlock means 55*a* and 55*b*, a bottom edge of each interlock flap contacts top edge 46 of a corner flap. This arrangement helps hold the corner flap in the downward position which, thereby, adds rigidity to the front corners of the fully-erected box.

Figure 4:
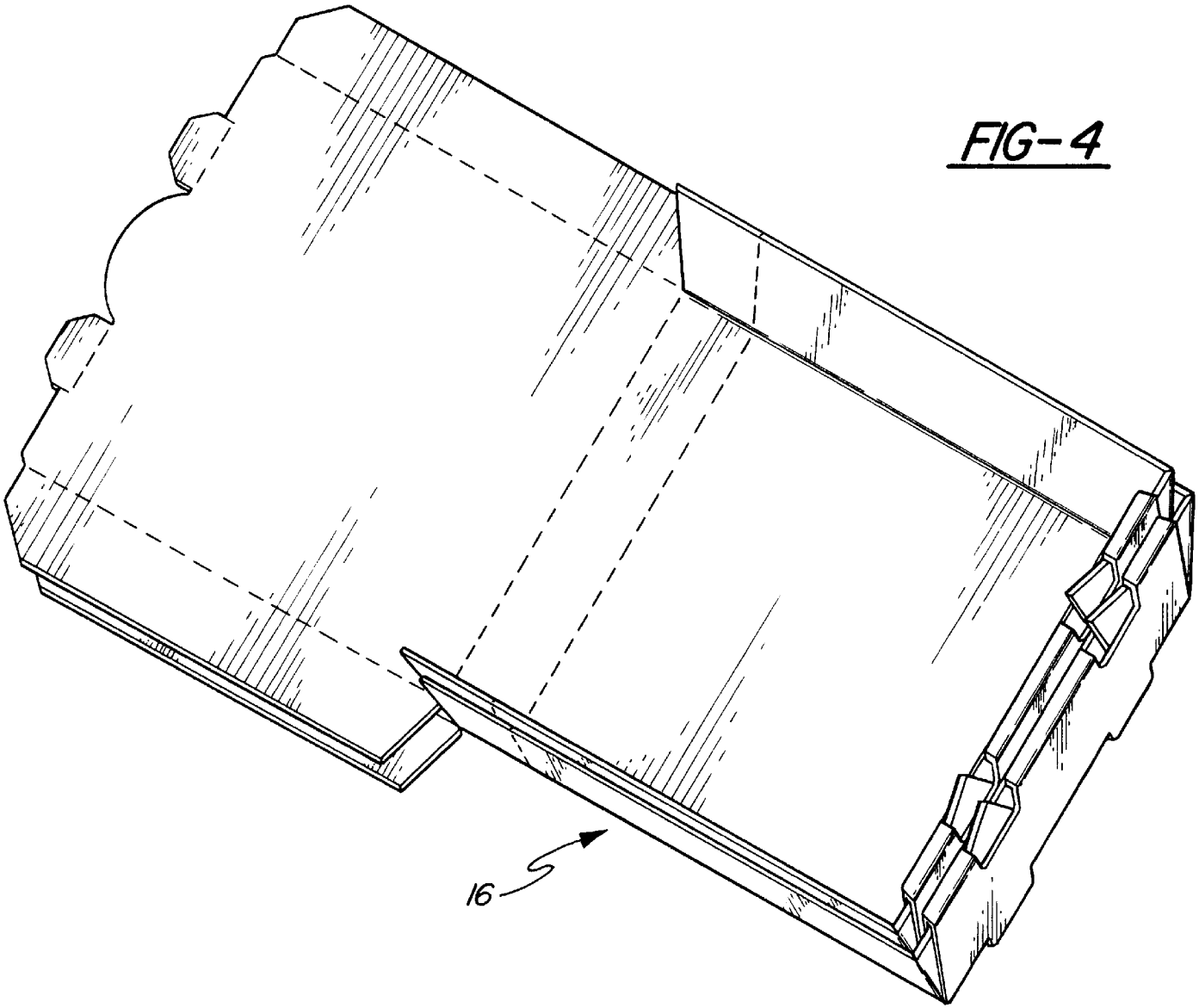
FIG. 4 is a perspective view of a stack of partially-erected boxes.

Option two involves the following steps. Instead of immediately placing a pizza into the box, the partially-erected box is nested inside another partially-erected box, as shown in FIG. 4, resulting in a stack 16 of partially-erected boxes. When it's needed, a partially-erected box is removed from the stack and placed on a table or other horizontal surface. After that, the same steps are employed as described in option one.

The practice of nesting partially-erected boxes results in a savings of about 70 percent in storage space compared to stacking fully-erected boxes. Of course, it's possible to nest partially-erected standard pizza boxes if they're made of thin E-flute or F-flute corrugated board and if the upper box is forced into the lower one. However, with my invention with its fall-back side walls, partially-erected boxes can be more easily nested together and then more easily separated from one another for use, even when made of B-flute board. This is a special benefit of my box that's not found with the standard pizza box.

Option three involves the following steps. Instead of immediately placing a pizza into the box or nesting partially-erected boxes together, the box is formed into a fully-erected box and then stacked up. When it's needed, a fully-erected box is removed from the stack, placed on a table, and opened up. At this point, side walls 41 either automatically move to fall-back position or are pushed to fall-back position, depending on the degree of frictional resistance incurred on flap 42 from its contact with panels 51 and 52. Finally, the same steps are employed as described in option one.

With all three options, the pizza can be cut either before it's put into the box or afterwards. If the former, the pizza is slid into the box with side walls 41 in fall-back position. Compared to the standard pizza box, this provides an extra-wide opening to the box cavity, thereby reducing the chance of pizza slices contacting the top edge of the side walls as the product is entering the box.

If the latter, the pizza is placed into the box and then cut with a pizza wheel with side walls 41 in fall-back position. However, it's also possible to start the pizza-cutting process with the side walls in vertical position. As the wheel contacts the side walls during cutting, they are automatically pushed to fall-back position by the wheel.

CONCLUSION, RAMIFICATIONS, AND SCOPE

I have disclosed an expandable pizza box that is easy and convenient to use because it folds up and handles in similar fashion to the standard pizza box. In addition, I have disclosed a pizza packaging methodology which, in combination with the box, provides the following advantages:

1) Easy, unobstructed loading of a pizza into the box;
2) Easier cutting of a pizza inside the box;
3) More complete cutting of the pizza in the box and/or a better-looking box due to no bent side walls from the cutting;
4) Easy nesting together of partially-erected boxes for space-savings, especially of boxes made of B-flute corrugated board;
5) No added training time and employee confusion resulting from radically different box-folding and handling procedures;
6) No additional packaging cost due to increased material or gluing process required to make the box.

For added convenience, a new type of sauce cup is recommended. Recently, some pizza companies have adopted the practice of including a cup of dipping sauce inside the box along with the pizza. The typical container used for carrying the sauce is a cylindrical plastic cup that's about one and three-fourths inches high and two inches diameter at the top. This vessel is placed in a corner of the box. Because the box corner is a 90 degree angle and the cup is round, packing the cup in the corner is unwieldy and creates problems.

For easier and more convenient sauce packing, the use of a "pizza-carton-compatible" sauce cup is suggested. One such cup is a three-sided sauce cup. An example of such an invention is cup 70 shown in FIG. 8. While not yet manufactured, such a device would be perfect for packing sauce in a pizza box because the amount of sauce packed in the current cylindrical cup could be packed in a squatter three-sided cup which also takes less space inside the pizza box. The advantages of the cup would be: (a) it makes it easier to pack a sauce cup inside a smaller box, (b) it makes it possible to stack two sauce cups on top of each other or aside each other in the same corner, thereby increasing the cup-carrying capacity of a box, and (c) it reduces the chance of the cup tipping over and rolling around inside the pizza box.

Regarding my expandable pizza box invention, the illustrated number, size, shape, type, and placement of components represent the preferred embodiment; however, many other combinations and configurations are possible within the scope of the invention.

In conclusion, it is understood that my invention is not to be limited to the disclosed embodiments but, on the contrary, is intended to cover various modifications and equivalent arrangements included within the spirit and scope of the appended claims.

I claim:

1. A partially-erected one-piece expandable pizza box made of foldable material and comprising:

a bottom panel having a rear edge, a side edge, and another edge adjacent said side edge and non-adjacent said rear edge, a rear wall hingedly attached to said rear edge and disposed substantially coplanar to said bottom panel, a cover panel hingedly attached to said rear wall and disposed substantially coplanar thereto, an upright double-panel wall structure comprising an outer panel attached to said another edge and an inner panel attached to a top edge of said outer panel and disposed substantially parallel to said outer panel, a fall-back side wall structure comprising:

(a) a side wall hingedly attached to said side edge and disposed in a fall-back position and being movable therefrom to a vertical position, (b) a fall-back corner flap attached to a front end of said side wall and at least partially disposed between said inner and outer panels, (c) a free-swinging verticalizing flap hingedly attached to a rear end of said side wall;

whereby, compared to a standard pizza carton having a stationary vertically-disposed side wall, said partially-erected one-piece expandable pizza box with said side wall disposed in said fall-back position provides opportunity for extra operational convenience such as easier loading of a pizza into the box, easier cutting of a pizza inside the box, or cutting of a pizza inside the box without running over or bending a side wall of the box.

2. First and second partially-erected one-piece expandable pizza boxes, the first box being nested inside the second box, each of said boxes comprising:

a bottom panel having a rear edge, a side edge, and another edge adjacent said side edge and non-adjacent said rear edge, a rear wall hingedly attached to said rear edge and disposed substantially coplanar to said bottom panel, a cover panel hingedly attached to said rear wall and disposed substantially coplanar thereto, an upright double-panel wall structure comprising an outer panel attached to said another edge and an inner panel attached to a top edge of said outer panel and disposed substantially parallel to said outer panel, a fall-back side wall structure comprising (a) a side wall hingedly attached to said side edge and (b) a fall-back corner flap attached to a front end of said side wall and at least partially disposed between said inner and outer panels, said side wall being disposed in a fall-back position;

whereby, compared to a first partially-erected standard pizza carton nested inside a second partially-erected standard pizza carton with each of the cartons having a stationary vertical side wall, said first partially-erected one-piece expandable pizza box fits more loosely inside of said second partially-erected one-piece expandable pizza box and can be more easily separated therefrom.

3. A fully-erected one-piece expandable pizza box made of foldable material and comprising:

a bottom panel, a fully-reclinable rear wall hingedly attached to said bottom panel, a cover hingedly attached to a top edge of said rear wall at a fold line, a double-panel front wall structure disposed parallel to said rear wall and comprising an outer panel attached to said bottom panel and an inner panel attached to a top edge of said outer panel by a top-edge fold line structure, first and second fall-back side wall structures disposed adjacent said double-panel front wall structure and comprising (a) respective first and second side walls hingedly attached to said bottom panel and (b) first and second fall-back corner flaps attached to a front end of said first and second side walls, respectively, and disposed between said inner and outer panels and each having a top edge;

wherein a substantial portion of the top edge of each of said first and second fall-back corner flaps is disposed substantially below said top-edge fold line structure, whereby after said fully-erected pizza box is opened up and formed into a partially-erected pizza box each of said first and second fall-back corner flaps can move from a downward position to an upward position and, thereby, said first and second side walls can move, correspondingly, from a vertical position to a fall-back position.

4. The box of claim 3 wherein:

said first and second fall-back side wall structures further comprise first and second verticalizing flaps hingedly attached to a rear end of said first and second side walls, respectively, whereby said cover is in contact with a top edge of said verticalizing flaps and, thereby, acts to keep said side walls from moving from said vertical position to said fall-back position.

5. The box of claim 3 wherein:

said foldable material has a predetermined thickness, said top-edge fold line structure comprises first and second substantially parallel fold lines spaced apart a predetermined distance and a narrow strip of material between said fold lines, said predetermined distance is less than three times said predetermined thickness.

6. The box of claim 3 wherein:

said foldable material has a predetermined thickness, said top-edge fold line structure comprises first and second substantially parallel fold lines spaced apart a predetermined distance and a narrow strip of material between said fold lines, said predetermined distance is at least three times said predetermined thickness.

7. The box of claim 3 wherein:

said foldable material has a predetermined thickness, said bottom panel has an interlock slot having a front-to-back width of a predetermined distance, said predetermined distance is less than three times said predetermined thickness.

8. The box of claim 3 wherein:

said foldable material has a predetermined thickness, said bottom panel has an interlock slot having a front-to-back width of a predetermined distance, said predetermined distance is at least three times said predetermined thickness.

9. The box of claim 3 wherein:

said cover comprises a cover panel and first and second cover side flaps attached to said cover panel, said cover side flaps are disposed interior to said first and second side walls.

10. The box of claim 3 wherein:

at least a portion of the top edge of each of said first and second fall-back corner flaps is substantially parallel to said top-edge fold line structure.

11. The box of claim 3 wherein:

said box is a non-glued box, wherein each panel, flap, and wall is free of attachment by glue to any other panel, flap, or wall.

12. The box of claim 3 wherein:

said first and second fall-back corner flaps are each a unitary structure free of fold lines.

13. The box of claim 3 wherein:

said first and second fall-back corner flaps each have a tab projecting downward from a bottom edge.

14. The box of claim 3 wherein:

said first and second fall-back corner flaps each have a diagonal fold line thereon.

15. The box of claim 3 wherein:

said cover comprises a cover panel and a flap attached to a front edge of said cover panel.

16. The box of claim 3 wherein:

said cover comprises a cover panel and an interlock flap attached to a front edge of said cover panel, said double-panel wall structure comprises a cover interlock means, said interlock flap is engaged with said cover interlock means and at least partially disposed between said inner and outer panels.

17. The box of claim 16 wherein:

said cover panel further comprises a front edge projection tab being at least 30 millimeters wide and extending beyond said double-panel front wall structure by more than six millimeters at a furthest point of said front edge projection tab.

18. The box of claim 3 wherein:

said cover comprises a cover panel and first and second interlock flaps attached to a front edge of said cover panel, said double-panel front wall structure comprises first and second cover interlock means, said first and second interlock flaps are engaged with said first and second cover interlock means, respectively, and are at least partially disposed between said inner and outer panels.

19. The box of claim 18 wherein:

an edge of said first and second interlock flaps is in contact with the top edge of said first and second fall-back corner flaps, respectively, whereby said fall-back corner flaps are retained in said downward position.

20. The box of claim 19 wherein:

said outer panel has first and second tabs projecting from a bottom edge of said outer panel and disposed directly below said first and second cover interlock means, respectively, whereby when a first fully-erected expandable pizza box is stacked on top of a second fully-erected expandable pizza box, the first and second tabs of the first box are disposed directly above the first and second cover interlock means of the second box, respectively.

21. A blank for an expandable pizza box having a double-panel wall structure, said blank being of foldable material cut and scored to define:

a bottom panel having a rear edge, a side edge substantially perpendicular to said rear edge, and another edge, a rear wall hingedly attached to said rear edge, a cover panel hingedly attached to said rear wall, a double-panel wall structure comprising an outer panel hingedly attached to said another edge and an inner panel hingedly attached to a top edge of said outer panel, a fall-back side wall structure comprising (a) a side wall hingedly attached to said side edge and having a side wall top edge and an imaginary line of projection extending from said side wall top edge and (b) a fall-back corner flap attached to an end of said side wall and disposed adjacent said outer panel and having a corner flap top edge;

wherein a substantial portion of said corner flap top edge is disposed substantially below said imaginary line of projection, whereby after the blank has been erected into a box and said fall-back corner flap is disposed between said inner and outer panels, said fall-back corner flap can move from a downward position to an upward position and vice versa and, correspondingly, said side wall can move from a vertical position to a fall-back position and vice versa, thereby enabling said blank to be formed into either a partially-erected pizza box having said side wall in said fall-back position or into a fully-erected pizza box having said side wall in said vertical position.

22. The blank of claim 21 wherein:

said fall-back side wall structure further comprises a free-swinging verticalizing flap hingedly attached to a rear end of said side wall and having a top edge substantially aligned with said side wall top edge, whereby after the blank is erected into a box, the top edge of said verticalizing flap is disposed in contact with said cover panel and, thereby, acts to keep said side wall from moving from said vertical position to said fall-back position.

* * * * *